US008259986B2

(12) United States Patent
Danovi et al.

(10) Patent No.: US 8,259,986 B2
(45) Date of Patent: Sep. 4, 2012

(54) LOUDSPEAKER MAGNETIC FLUX COLLECTION SYSTEM

(75) Inventors: Benny Danovi, Nashville, IN (US); Eric Royse, Indianapolis, IN (US)

(73) Assignee: Harman International Industries, Incorporated, Northridge, CA (US)

( * ) Notice: Subject to any disclaimer, the term of this patent is extended or adjusted under 35 U.S.C. 154(b) by 1100 days.

(21) Appl. No.: 12/034,293

(22) Filed: Feb. 20, 2008

(65) Prior Publication Data

US 2008/0205690 A1 Aug. 28, 2008

Related U.S. Application Data

(60) Provisional application No. 60/891,169, filed on Feb. 22, 2007.

(51) Int. Cl.
*H04R 1/00* (2006.01)

(52) U.S. Cl. ..... 381/397

(58) Field of Classification Search ..... 381/397, 381/412
See application file for complete search history.

(56) References Cited

U.S. PATENT DOCUMENTS

| | | | | |
|---|---|---|---|---|
| 6,563,932 | B2 * | 5/2003 | Cork | 381/412 |
| 6,671,385 | B2 * | 12/2003 | Suzuki et al. | 381/412 |
| 6,868,165 | B1 * | 3/2005 | Fabian | 381/397 |
| 6,940,992 | B2 | 9/2005 | Stiles | 381/412 |
| 2004/0245864 | A1 * | 12/2004 | Bailey | 310/15 |
| 2006/0256997 | A1 * | 11/2006 | Sagren | 381/412 |
| 2007/0165902 | A1 * | 7/2007 | Matsumura et al. | 381/396 |
| 2007/0230738 | A1 | 10/2007 | Royse | 381/433 |

FOREIGN PATENT DOCUMENTS

| | | | |
|---|---|---|---|
| EP | 1 227 701 | A1 | 7/2002 |
| JP | 61-074499 | | 4/1986 |
| JP | 61074499 | A | 4/1986 |
| JP | 61-184096 | | 8/1986 |
| JP | 61184096 | A | 8/1986 |
| JP | 3220897 | A | 9/1991 |
| JP | 7-7792 | | 1/1995 |
| JP | 7007792 | A | 1/1995 |
| JP | 07007792 | A | 1/1995 |

(Continued)

OTHER PUBLICATIONS

Notice Requesting Submission of Opinion, Nov. 16, 2010, in Korean Application No. 10-2009-7017584.

(Continued)

*Primary Examiner* — Charles Garber
*Assistant Examiner* — Andre' C Stevenson
(74) *Attorney, Agent, or Firm* — Brinks Hofer Gilson & Lione

(57) ABSTRACT

A loudspeaker design delivers improved efficiency by reducing the power required from an audio source to produce sound. The loudspeaker includes a magnet housing, at least two magnets and a magnetic flux collector. The magnetic flux collector is coupled with and extends away from the magnet housing. Magnetic flux generated by the magnets is received and channeled by the magnetic flux collector and the magnet housing to an air gap included in the loudspeaker to maximize the availability of the magnetic energy of the magnets in the air gap.

33 Claims, 7 Drawing Sheets

FOREIGN PATENT DOCUMENTS

| | | | |
|---|---|---|---|
| JP | 9-154193 | | 6/1997 |
| JP | 9154193 | A | 6/1997 |
| JP | 11252685 | A | 9/1999 |
| JP | 2002078081 | A | 3/2002 |
| JP | 2002-262390 | | 9/2002 |
| JP | 2003-032784 | | 1/2003 |
| JP | 2007-005845 | | 1/2007 |

OTHER PUBLICATIONS

Japanese Office Action, Sep. 16, 2011, JP 2009-550986, 12 pgs.

International Preliminary Report on Patentability, Aug. 26, 2009, The International Bureau of WIPO, Switzerland.

* cited by examiner

LOUDSPEAKER MAGNETIC FLUX COLLECTION SYSTEM

PRIORITY CLAIM

This application claims the benefit of priority from U.S. Provisional Application No. 60/891,169, filed Feb. 22, 2007, which is incorporated by reference.

BACKGROUND OF THE INVENTION

1. Technical Field

The invention relates to loudspeakers for producing audible sound, and more particularly to a magnetic flux collection system for a loudspeaker.

2. Related Art

A transducer is a device that converts one form of an input signal to another form. Loudspeakers are one example of a transducer. Loudspeakers convert electrical signals to audible sound. Loudspeakers include a diaphragm, a voice coil and a magnet structure. The voice coil is connected to the diaphragm and is disposed in an air gap. The magnet structure generates a magnetic flux in an air gap between the magnet structure and the voice coil. Input current flowing through the voice coil creates an induced magnetic field that interacts with the magnetic field in the air gap. This may cause the voice coil to move, which in turn causes the diaphragm to move or vibrate. As a result, sound is generated. Other structures such as a spider, a surround, and a frame, may be used to form a loudspeaker.

SUMMARY

A magnet structure in a loudspeaker may include at least two magnets, a magnet housing, and a magnetic flux collector. The magnetic flux collector reduces the dispersion of magnetic energy produced by at least one of the magnets. Instead, the magnetic flux collector provides a direct, low reluctance, and controlled path for magnetic energy to be channeled into an air gap included in the loudspeaker.

The magnetic flux collector is constructed of a magnetically conductive material (ferromagnetic). The magnetic flux collector may extend away from and be coupled with the magnet housing of the loudspeaker. The loudspeaker may include one or more magnets disposed in a predetermined configuration in the magnet housing. The magnetic flux collector may attract and focus magnetic energy back into the magnet housing and into the air gap. The magnetic flux collector may be integrated into the magnet housing, into a frame of the loudspeaker adjoining the magnet housing, or a combination of the magnet housing and the frame. The magnet structure may also include a cap constructed with magnetically conductive material. The cap may be positioned adjacent to a magnetic pole of one of the magnets to direct the magnetic energy toward the magnetic flux collector.

In one example, a loudspeaker may be manufactured by separately constructing a first assembly and a second assembly. The first assembly and the second assembly are each a portion of the loudspeaker. The first assembly may include a magnet housing and a magnetic flux collector. The second assembly may include a support frame and a cone of the loudspeaker. The first assembly and second assembly may be detachably coupled to form the loudspeaker. Accordingly, the first assembly or second assembly may be replaceable parts. Thus, either the first assembly or the second assembly may be replaced with a different first assembly or second assembly by detaching the first and second assemblies, replacing one of the first assembly or second assembly, and reusing the other of the first assembly or the second assembly to form a loudspeaker.

Other systems, methods, features and advantages of the invention will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

Figure 1:
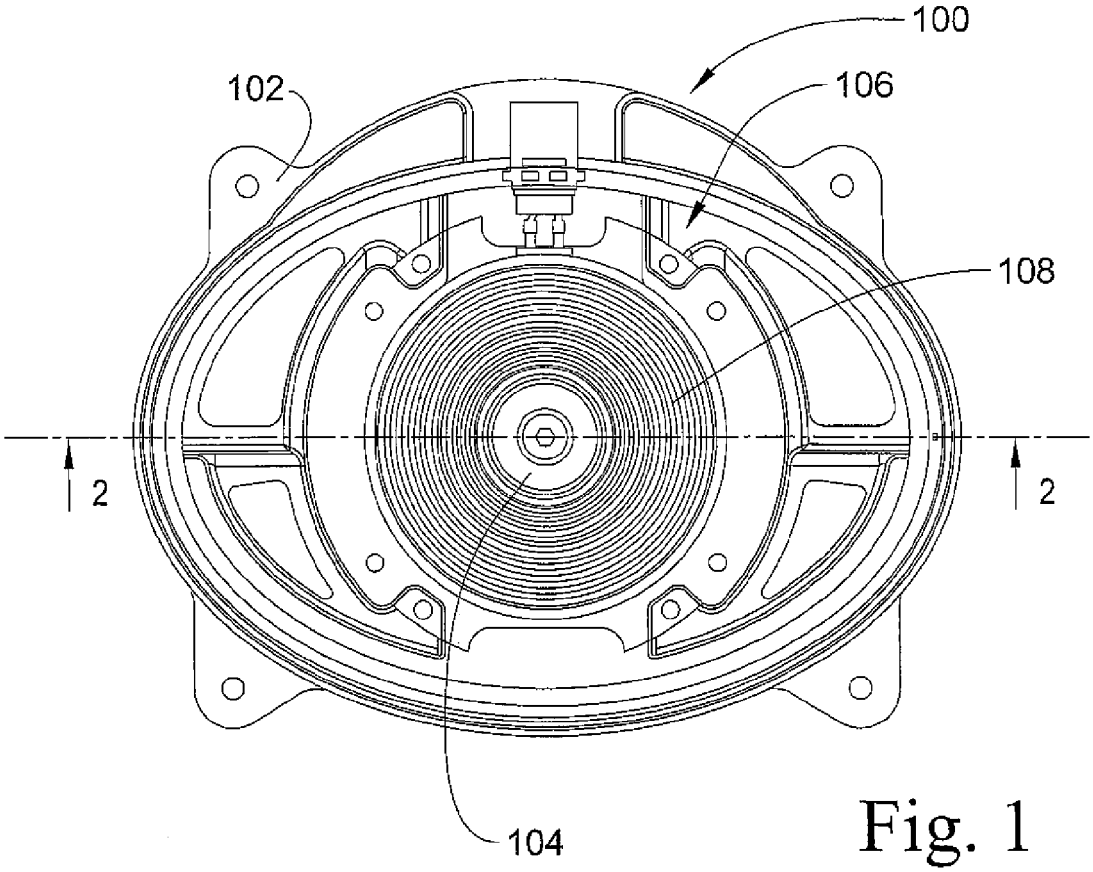
FIG. 1 is a plan view of an example loudspeaker that includes a magnetic flux collector.

FIG. 1 is a plan view of an example loudspeaker 100 that includes a support frame 102, a motor assembly 104, a magnetic flux collector 106 and a spider 108. In FIG. 1, the loudspeaker 100 is illustrated in a generally oval shape. In other examples, different geometric loudspeaker shapes may also be used such as squares, circles, rectangles and so forth. In addition, the components that are described as included in the loudspeaker 100 should be viewed in an illustrative sense and not as limitations or required components. Some of the described example components may be omitted, and/or other components may be used within the loudspeaker 100 in other examples.

Figure 2:
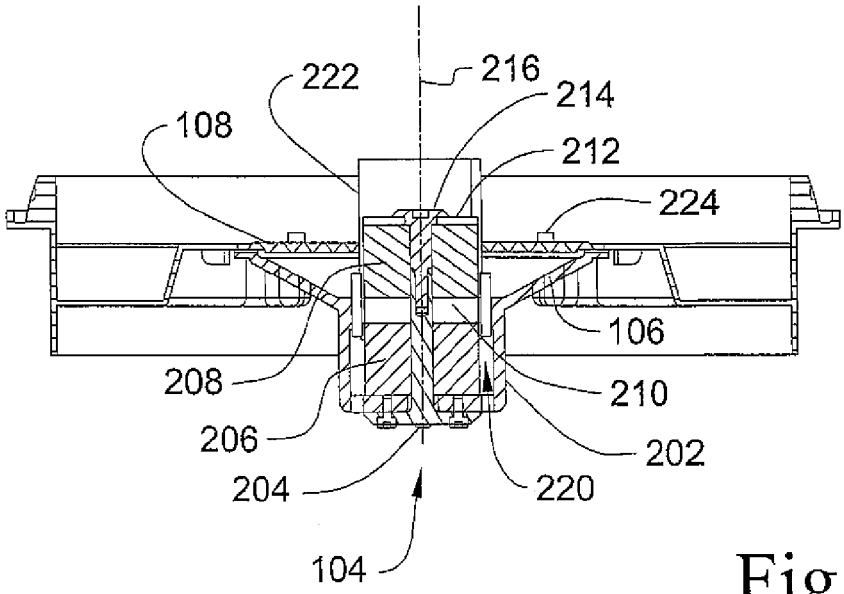
FIG. 2 is a cut-away side view of the loudspeaker of FIG. 1.

FIG. 2 is a cut-away side view of the loudspeaker 100 of FIG. 1 along line 2-2. In FIGS. 1 and 2, the loudspeaker 100 may include the support frame 102, the motor assembly 104, the magnetic flux collector 106 and a magnet housing 202. The support frame 102 may be formed from any rigid material, such as plastic, aluminum, steel, carbon fiber, magnesium, or other materials. The motor assembly 104 may include a first centering pin 204, a first magnet 206, a second magnet 208, a first core cap 210, a second core cap 212, and a second centering pin 214. In other examples, the motor assembly 104 may include three or more magnets. Additionally or alternatively, the centering pin, and/or the second core cap may be omitted.

The magnet housing 202 may be formed of any type of magnetically conductive material (ferromagnetic) that is configurable to include a base and a surrounding wall that define a hollow cavity. In one example, the magnet housing 202 may be referred to as a shellpot. The first magnet 206 may be disposed at least partially in the hollow cavity contiguous with the base of the magnet housing 202 and at least partially surrounded by the wall of the magnet housing 202. The first magnet 206 may be coupled with the base of the magnet housing 202 with a mechanical fastener, an adhesive, friction fit, or any other mechanism to fixedly couple the first magnet 206 with the base of the magnet housing 202. The second magnet 208 may be disposed adjacent to the first magnet 206 with the first core cap 210 positioned between the first magnet 206 and the second magnet 208. The second magnet 208 may be at least partially outside the magnet housing 202.

In FIG. 2, the second magnet 208 is positioned almost entirely outside the magnet housing 202 such that most of the magnetic field produced by the second magnet 208 is not channeled through the magnet housing 202. The second core cap 212 may be positioned in contiguous contact with the second magnet 208 on a side of the second magnet 208 that is opposite the first core cap 210. The first and second magnets 206 and 208 may be formed from any magnetic material, such as iron, cobalt, nickel, or polymer, that is capable of producing or being charged to produce magnetic energy. In FIG. 2, the first magnet 206 is operable as a primary magnet, and the second magnet 208 is operable as a bucking magnet. Thus, the polarity of the first and second magnets 206 and 208 is such that the same polarity of the first and second magnets 206 and 208 are positioned to be facing one another on the opposite sides of the first core cap 210.

During operation of the example in FIG. 2, the magnetic energy from the first magnet 206 may be channeled substantially through the magnet housing 202 and an air gap 220 formed between the motor assembly 104 and the magnet housing 202 to complete a first magnetic circuit. The air gap 220 is a predetermined location where the magnetic energy of the magnets 206 and 208 is concentrated. The magnetic energy of a top pole of the second magnet 208 (the bucking magnet) positioned adjacent the second core cap 212, may travel mostly through air, including the air gap 220, in order to complete a second magnetic circuit. Travel through air of the magnetic energy of the second magnet 208 reduces the level of magnetic energy relatively quickly because the magnetic reluctance of air is relatively high. The reluctance of the magnetic flux collector 106, on the other hand, is relatively low, and the magnetic energy generated by the second magnet 208 is channeled through the magnetic flux collector 106 to the air gap 220, rather than traveling through air. Thus, the magnetic flux collector 106 reduces the amount of travel of the magnetic energy of the second magnet 208 through air in order to maximize the magnetic energy level being supplied to the air gap 220. As a result, the magnitude of magnetic energy from the second magnet 208 that is available to contribute to operation of the loudspeaker is significantly increased by use of the magnetic flux collector 106.

The motor assembly 104 and the magnet housing 202 may be aligned to be concentric with a central axis 216 of the loudspeaker 100. The first magnet 206, the second magnet 208, the first core cap 210 and the second core cap 212 may be fixedly held in relative position to each other and the magnet housing 202 by adhesive, mechanical fasteners, interlocking features, or any other mechanism. The magnetic flux collector 106 also may be aligned to be concentric with magnet housing 202 and/or the central axis 216 of the loudspeaker 100.

In FIG. 2, each of the base of the magnet housing 202, the first magnet 206, the second magnet 208, the first core cap 210, and the second core cap 212 may include an aperture to accommodate the first and second centering pins 204 and 214. The apertures may be formed along the central axis 216. Thus, the first magnet 206, the second magnet 208, the first core cap 210 and the second core cap 212 may be fixedly coupled together and to the base of the magnet housing 202 with a coupling mechanism formed with the first and second centering pins 204 and 214. In other examples, the first and second centering pins 204 and 214 may be a single member, or any other configuration that holds in place the components included in the motor assembly 104. Also, the first and second centering pins 204 and 214 may be a single member formed as a post. In this configuration, the magnetic energy of the first magnet 206 and the second magnet 208 may be used in conjunction with the post to hold the first magnet 206, the second magnet 208, the first core cap 210 and the second core cap 212 in place. In addition, or alternatively, multiple coupling mechanisms, or posts that are offset from the central axis 216 may be used to maintain the position of the components of the motor assembly 104 with respect to each other and the magnet housing 202.

The first and second centering pins 204 and 214 may be any design that provides a rigid keeper function to maintain the position of the first magnet 206, the second magnet 208, the first core cap 210 and the second core cap 212 with respect to each other and the magnet housing 202. In FIG. 2, the first and second centering pins 204 and 214 are a threaded two-piece design that includes outer flanges formed to contact the base of the magnet housing 202 and the second core cap 212. In one example, the configuration of the first magnet 206, the second magnet 208, the first core cap 210, and the second core cap 212 in contiguous contact may form a pot type multiple magnet stator configuration.

A voice coil 222 may be supported by the spider 108 within the air gap 220 in the magnetic field produced by the first and second magnets 206 and 208. Thus, the voice coil 222 is subject to the concentrated magnetic energy of the magnets 206 and 208. The spider 108 may include a central opening to which the voice coil 222 is coupled at an inner periphery of the spider 108. The spider 108 may be coupled at an outer periphery to the support frame 102, the magnetic flux collector 106, or a combination of the support frame 102 and the magnetic flux collector 106. As described later, in FIG. 2, the spider 108 is coupled with the magnetic flux collector 106.

Generally, during operation, current from an amplifier supplying electric signals representing program material to be transduced by the loudspeaker 100 drives the voice coil 222. The voice coil 222 may generate an induced magnetic field based on the electric signals. Interaction of the induced magnetic field with a magnetic field produced by the first magnet 206 and the second magnet 208 may cause the voice coil 222 to reciprocate axially while supported and maintained in a desired range of reciprocation motion by the spider 108. Reciprocation of the voice coil 222 generates sound representing the program material transduced by the loudspeaker 100.

The magnetic flux collector 106 may be formed of any material capable of conducting magnetic energy, such as steel. The magnetic flux collector 106 may be coupled with the magnet housing 202, or may be integrally formed as part of a single unitary structure that includes at least a portion of the magnet housing 202. The magnetic flux collector 106 may also be coupled with the support frame 102. In FIG. 2, the magnetic flux collector 106 may be coupled with the support frame 102 by fasteners, such as machine screws 224. In other examples, the magnetic flux collector 106 may be integrally formed with support frame 102, overmolded by the support frame 102, glued to the support frame 102, welded to the support frame 102, and/or coupled by some form of mechanical connection, such as a threaded connection, a snap fit and/or a frictional fit.

Figure 3:
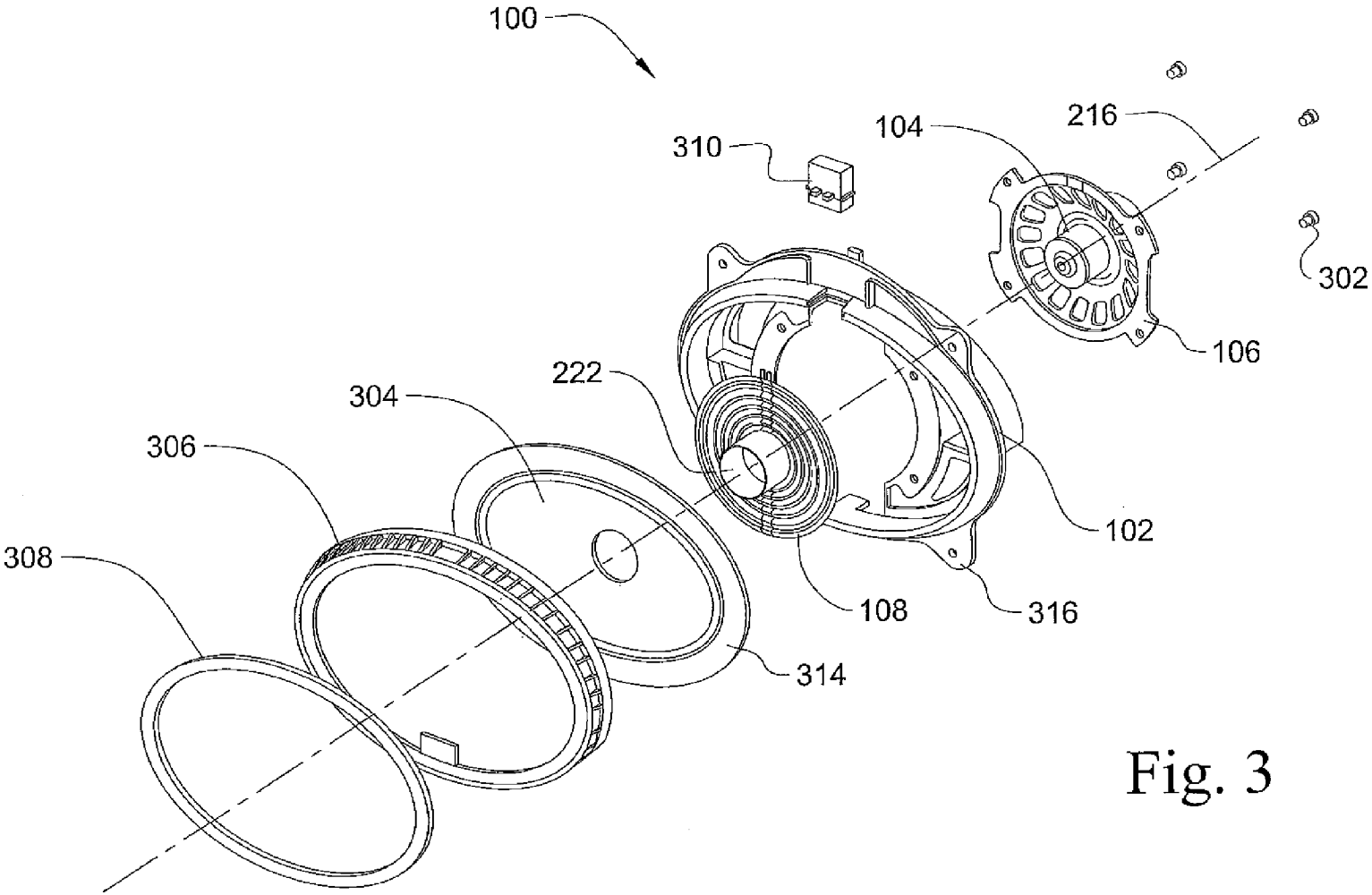
FIG. 3 is an exploded view of the loudspeaker of FIG. 1.

FIG. 3 is an exploded perspective view of the example loudspeaker of FIGS. 1 and 2. In FIG. 3, the magnetic flux collector 106 is coupled with the motor assembly 104. The magnetic flux collector 106 is also coupled with the support frame 102 by a coupling mechanism, such as fasteners 302. FIG. 3 also illustrates a cone 304, a pad ring 306, a top gasket 308, and a electrical connector 310 that may be coupled with the support frame 102. In other examples, the pad ring 306, and/or top gasket 308 may be omitted. A central apex of the cone 304 may be attached to an end of the voice coil 222 near the motor assembly 104. An outer peripheral edge of the cone 304 may be coupled to the surround 314 or other compliance structure. The surround 314 may be attached at an outer perimeter to the support frame 102. In other examples, the surround 314 may be omitted and the cone 304 may be directly coupled with the support frame 102. The support frame 102 may also include a lip, ears, or other mechanism 316 that may be used to support mounting of the loudspeaker 100 in a desired location such as on a surface or in a loudspeaker enclosure. The spider 108, the voice coil 222, the cone 304, the pad ring 306, the top gasket 308, and the surround 314 may be positioned concentric with the central axis 216.

The electrical connector 310 is an example of a terminal for coupling conductors to the loudspeaker 100. Such conductors may provide electrical signals representative of program material. The electrical connector 310 may include a positive and negative connection point to the loudspeaker 100. The electrical connector 310 may also be coupled with the voice coil 222. In FIG. 3, the electrical connector 310 is a two piece socket connector having a male piece and a female piece. In other examples, any other form of electrical connection may be used, including, but not limited to, screw terminals, solder connections, crimp connectors, banana plug sockets, and other connections.

Figure 4:
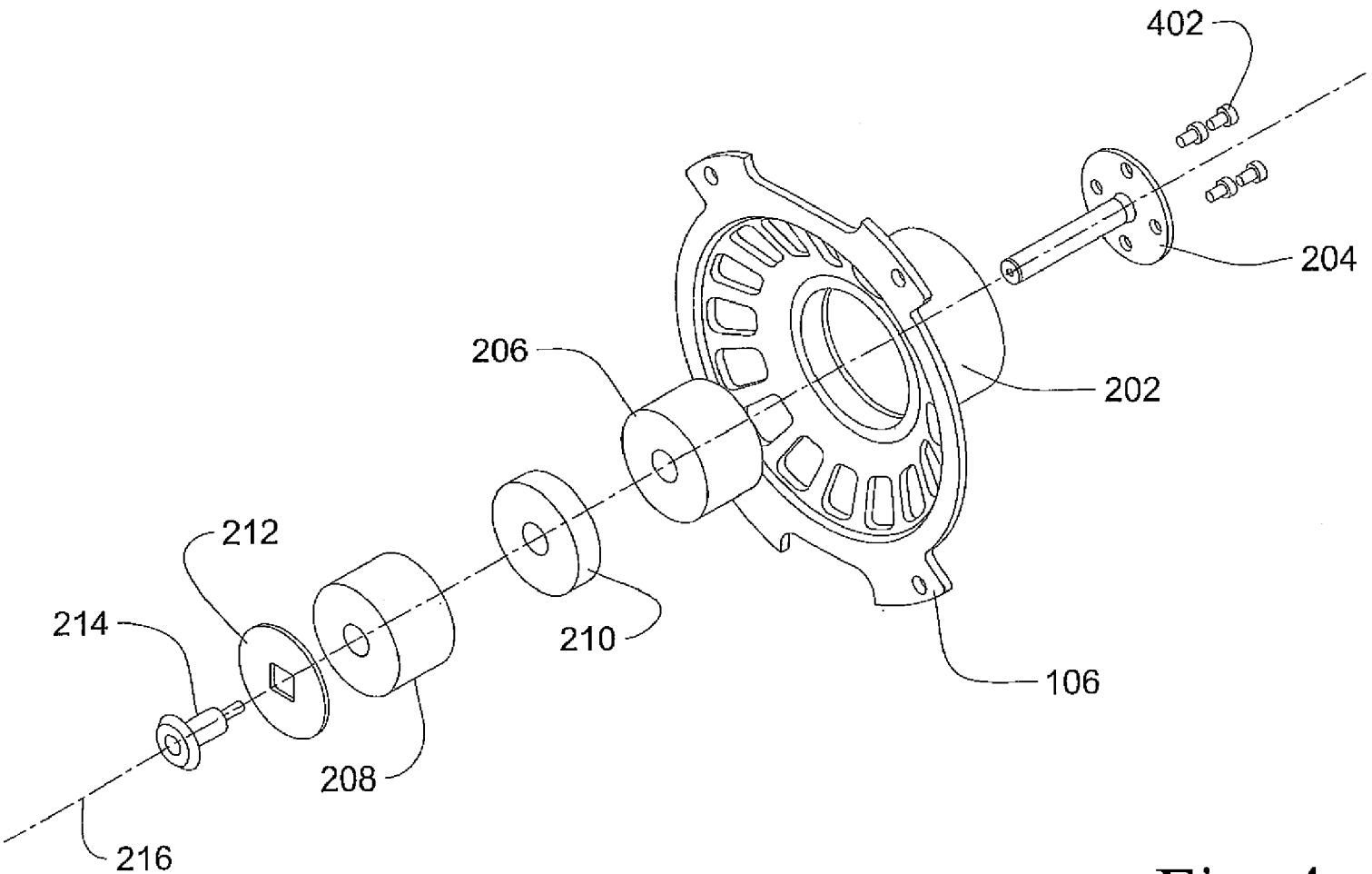
FIG. 4 is an exploded view of a motor assembly, a magnet housing and the flux collector included in the loudspeaker of FIG. 3.

FIG. 4 is an exploded perspective view of an example of the motor assembly 104 and the magnetic flux collector 106. In FIG. 4, the magnet housing 202 and the magnetic flux collector 106 are integrally formed as a single unitary structure. For example, the magnet housing 202 and the magnetic flux collector 106 may be a single machined part. In other examples, the magnet housing 202 and the magnetic flux collector 106 may be a two-piece forged and machined part, or a three-piece forged, machined and stamped part. In the two and three piece examples, the pieces may be permanently coupled to form the single unitary structure by welding, threaded connection, press fit, friction fit, or any other mechanism. In other examples, the magnet housing 202 and the magnetic flux collector 106 may be separately manufactured pieces that are coupled during the loudspeaker assembly process.

In FIGS. 2 and 4, the first centering pin 204 is coupled with the magnet housing 202 by fasteners, such as machine screws 402. In other examples, any other coupling mechanism may be used to fixedly couple the first centering pin 204 to the magnet housing 202. In still other examples, the first centering pin 204 may be integrally formed with the magnet housing 202.

In FIG. 4, the second centering pin 214 may be threaded into the first centering pin 204 to fixedly hold the magnet housing 202, the first magnet 206, the first core cap 210, the second magnet 208, and the second core cap 212 in positional relationship with each other concentric with the central axis 216 of the loudspeaker. In other examples, any other mechanism or material, such as an adhesive, may be used to maintain the positional relationships.

In one example, the first centering pin 204 may form a post that extends from the base of the magnet housing 202 through the motor assembly 104, and the second centering pin 214 may be omitted. In this example, the magnetic energy of the first and second magnets 206 and 208 may be used to fixedly hold the magnet housing 202, the first magnet 206, the first core cap 210, the second magnet 208, and the second core cap 212 in positional relationship with each other, and the first centering pin 204 (the post) may maintain the motor assembly 104 concentric with the central axis 216 of the loudspeaker.

The first and second centering pins 204 and 214 may be formed of any rigid material that does not conduct magnetic energy, such as brass, ceramic, carbon fiber, plastic, wood or glass. Thus, magnetic fields of the first and second magnets 206 and 208 are not channeled through the first and second centering pins 204 and 214, but instead are channeled through the magnetic flux collector 106 and the magnet housing 202 into the air gap 220.

Figure 5:
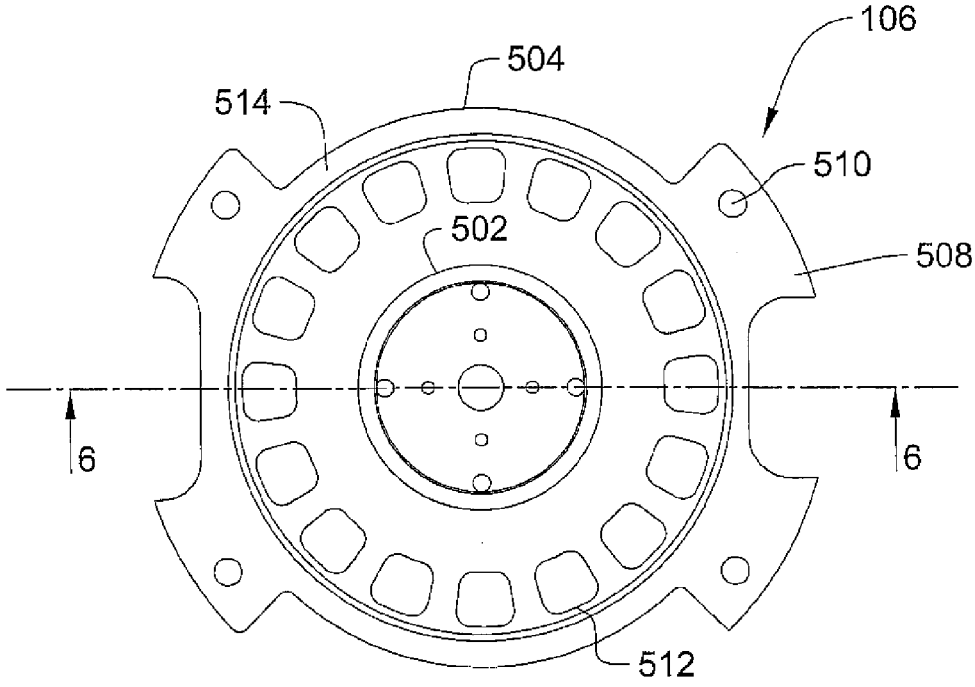
FIG. 5 is a plan view of an example magnetic flux collector and a magnet housing.

FIG. 5 is an example of a magnetic flux collector 106 that is formed integrally with a magnet housing 202. In FIG. 5, the magnetic flux collector 106 is circular and does not include the motor assembly for clarity of illustration. The magnetic flux collector 106 includes an inner diameter 502 that is a radial diameter, and an outer diameter 504 that is a radial diameter, both of which are generally circular. In other examples, where the magnetic flux collector 106 is oval, square, rectangular, or any other shape, the inner and outer diameters 502 and 504 may be a corresponding shape defining a respective inner and outer periphery of the magnetic flux collector. Thus, as used herein, the inner diameter 502 is defined as the inner periphery of the magnetic flux collector 106, and the outer diameter 504 is defined as the outer periphery of the flux collector 106 regardless of the shape of the inner and outer periphery of the magnetic flux collector 106.

The body of the magnetic flux collector 106 extends between the inner diameter 502, and the outer diameter 504. The inner diameter 502, the outer diameter 504 and the body are concentric with the central axis 216. The inner diameter 502 defines a central aperture formed to accommodate the magnet housing 202. Accordingly, the body of the magnetic flux collector 106 may uniformly extend outward from the magnet housing 202 to the outer diameter 504. In FIG. 5, the magnetic flux collector 106 is coupled with the magnet housing 202 to form a one piece machined component formed as a single unitary structure. As previously discussed, in other examples, other manufacturing configurations in which the magnetic flux collector 106 is formed separately and coupled with the separately formed magnet housing 202 are possible.

Figure 6:
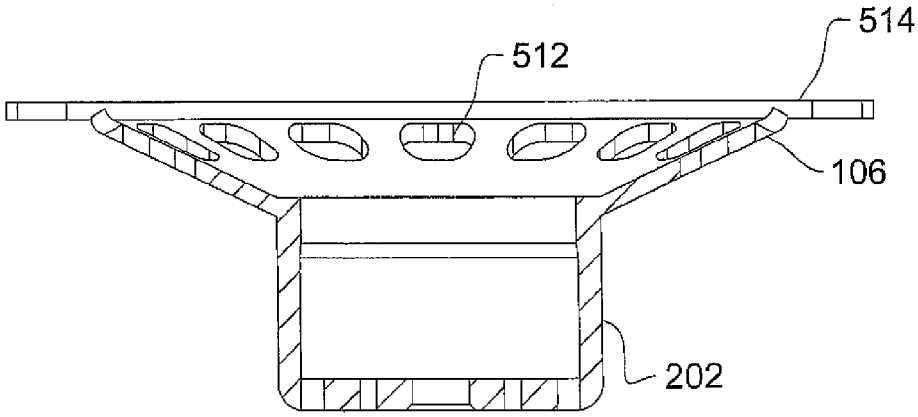
FIG. 6 is a cut away side view of the magnetic flux collector and magnet housing of FIG. 5.

FIG. 6 is a cutaway view of the magnetic flux collector 106 and the magnet housing 202 of FIG. 5. In FIG. 6, the magnetic flux collector 106 and the magnet housing 202 are coupled at a periphery of the magnet housing 202 that is opposite the base of the magnet housing 202. In other examples, the magnetic flux collector 106 and magnet housing 202 may be coupled at any location along the wall of the magnet housing 202. At whatever location the magnetic flux collector 106 and magnet housing 202 are coupled, both the magnetic flux collector 106 and the magnet housing 202 may be formed with sufficient magnetically conductive material to channel the magnetic flux of the first and second magnets 206 and 208 to the air gap 220 without oversaturation.

In FIGS. 5 and 6, the magnetic flux collector 106 includes a plurality of mounting flanges 508. The mounting flanges may be any mechanism or member that enables coupling of the magnetic flux collector 106 to the support frame 102 (FIG. 1). The mounting flanges 508 may be positioned proximate the outer diameter 504. Alternatively, the mounting flanges 508 may be located elsewhere on the body of the magnetic flux collector 106. In FIGS. 5 and 6, each of the mounting flanges 508 includes an aperture 510. The aperture 510 may be formed to accommodate a fastener, such as a machine screw. In other examples, any other form of mounting mechanism may be used with the mounting flanges 508, such as clips, snaps, or other mechanisms to fixedly couple the magnetic flux collector 106 and the support frame 102. Thus, the magnetic flux collector 106 may be operable as structural member to fixedly maintain the position of the magnet housing 202 with respect to the support frame 102. In one example, the magnetic flux collector 106 may be the only structural member that maintains the fixed position of the magnet housing 202 with respect to the support frame 102.

The magnetic flux collector 106 also includes a plurality of vent apertures 512 and a spider platform 514. The vent apertures 512 penetrate the magnetic flux collector 106 to provide air flow. The air flow allows the spider 108 to move freely as the voice coil reciprocates during operation of the loudspeaker 100. The vent apertures 512 may be sized and positioned to minimize air pressure or vacuum pressure being asserted on the spider 108 as the voice coil 222 reciprocates in the air gap 220. The spider platform 514 may provide a coupling mechanism, such as a planar surface to receive an adhesive, to fixedly couple the spider 108 (FIG. 2) to the magnetic flux collector 106. As illustrated in FIGS. 2 and 3, the spider 108 may be coupled at an outer perimeter of the spider 108 to the spider platform 514. The spider 108 may be coupled with the spider platform 514, with an adhesive, such as glue, with a mechanical mechanism, such as a clamp, and/or with a holding mechanism, such as a slot or channel.

During manufacturing, the spider 108 may be coupled with the spider platform 514 before or after the magnetic flux collector 106 is coupled with the support frame 102 (FIG. 1). The spider platform 514 may support and fixedly maintain the position of the outer perimeter of the spider 108. Accordingly, the spider 108 may support and constrain the voice coil 222 to reciprocate axially with respect to not only the flux collector 106, but also the support frame 102, and the magnet housing 202 that is rigidly coupled with the magnetic flux collector 106.

Thus, the magnet housing 202 and the magnetic flux collector 106 of a loudspeaker 100 are utilized as a structural first half of the loudspeaker assembly. The magnet housing 202 and magnetic flux collector 106 support the spider 108, the voice coil 222, and the motor assembly 104 of the loudspeaker 100. Thus, the combination of the magnet housing 202 and magnetic flux collector 106 maintain the positional relationship of the spider 108, the voice coil 222, and the motor assembly 104 of the loudspeaker 100 while also providing a channel for magnetic flux of the magnets in the motor assembly. The magnetic flux collector 106 may be attached to a second half of the loudspeaker assembly by fasteners, such as bolts, screws, or other fasteners, or by overmolding the magnetic flux collector 106 into a plastic mold of the support frame 102 to form a complete assembly.

Use of the spider platform 514 to support the spider 108 advantageously reduces the overall depth of the assembled loudspeaker 100 in comparison to conventional loudspeaker designs. In one example, the overall depth of the loudspeaker 100 is reduced by several millimeters. The magnitude of savings in the depth of a loudspeaker may vary depending on the size of loudspeaker. In addition, significant manufacturing advantages may be achieved by having the spider 108 coupled with the spider platform 514. For example, the spider 108 may be manufactured as part of a separate assembly representing the first half of the loudspeaker assembly that includes the motor assembly 104 and the flux collector 106, while the cone 304, support frame 102, etc. may be separately manufactured as the second half of the loudspeaker assembly. Thus, when the magnetic flux collector 106 is coupled with the support frame 102, assembly of the loudspeaker 100 is complete. The assembly that includes the cone 304 and support frame 102 may be supplied as a replaceable part so that the spider 108, motor assembly 104 and the magnetic flux collector 106 assembly may be reused.

Figure 7:
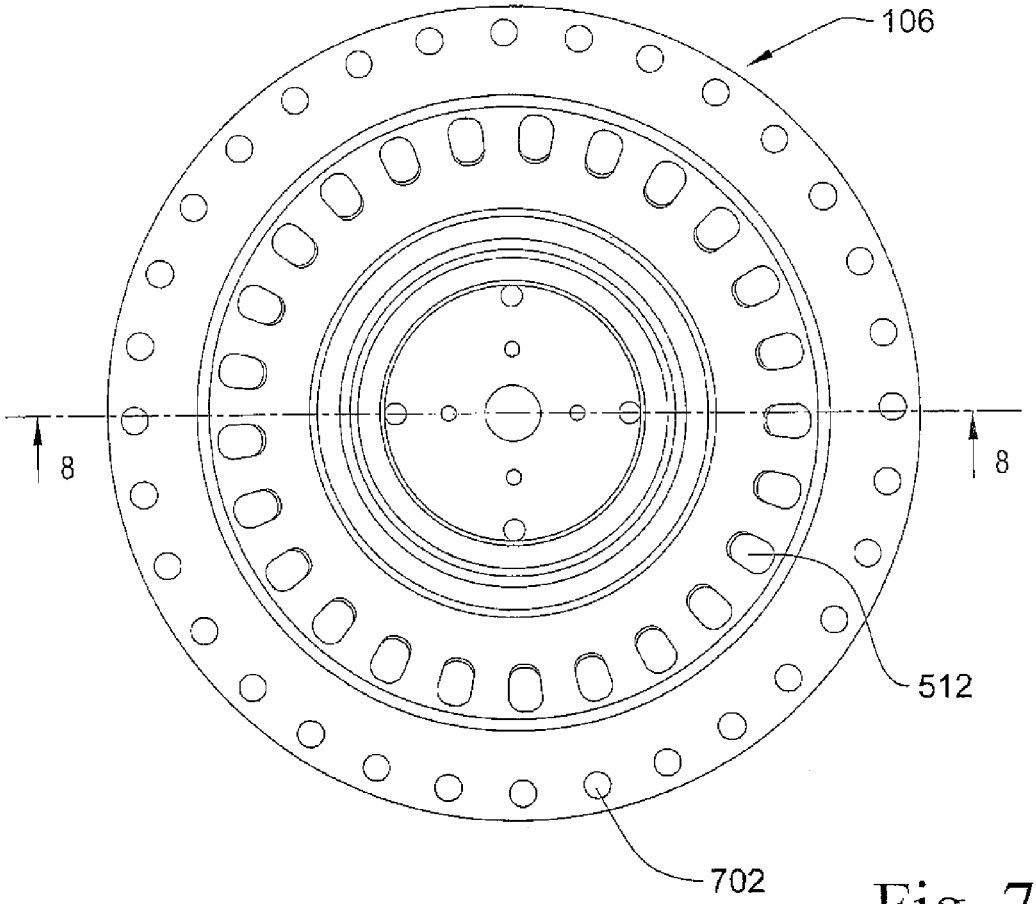
FIG. 7 is a plan view of another example magnetic flux collector and a magnet housing.
Figure 8:
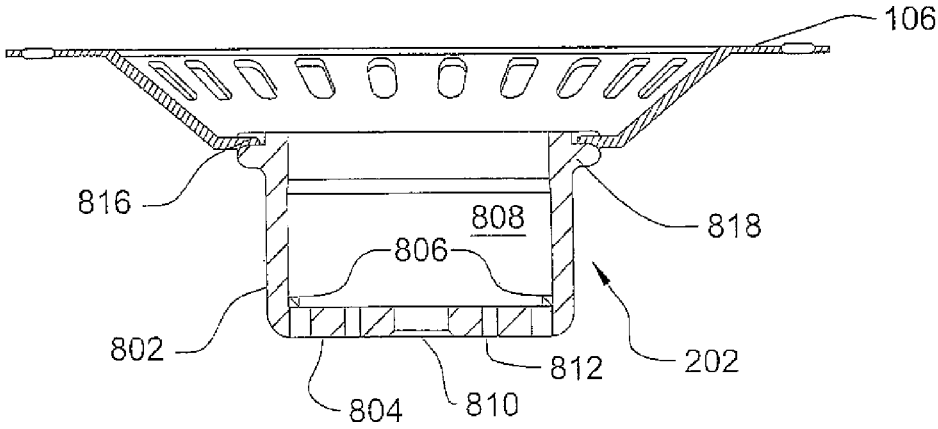
FIG. 8 is a partial cut away side view of the magnetic flux collector and magnet housing of FIG. 7.

FIG. 7 is another example of a magnetic flux collector 106 that is coupled with a magnet housing 202. FIG. 8 is a partial cutaway view illustrating a cross-section of the magnetic flux collector 106 and the magnet housing 202 of FIG. 7. In FIGS. 7 and 8, the magnetic flux collector 106 and the magnet housing 202 are formed as three separate pieces that are coupled together (three-piece design). In another example, a two piece design may be implemented in which the magnet housing 202 may be forged and machined, and the magnetic flux collector 106 may be a stamped part. Similar to the example of FIGS. 5 and 6, the magnetic flux collector 106 may include vent apertures 512 to allow air flow as the spider 108 reciprocates.

The magnetic flux collector 106 may also be overmolded. For example, a plastic support frame 102 may be molded in a plastic mold. The magnetic flux collector 106 may be inserted in the plastic mold prior to the molding process such that liquid plastic forming the support frame 102, will envelope a portion of the magnetic flux collector 106 prior to curing. Accordingly, when the molding process is complete, the magnetic flux collector 106 will be fixedly mounted to the support frame 102. In that regard, the magnetic flux collector 106 may include a plurality of retention apertures 702 formed in the magnetic flux collector 106. When the liquid plastic enters the plastic mold, the plastic may flow through the retention apertures 702 and form a single unitary plastic stricture that fills the retention apertures 702 and covers a radial edge of the magnetic flux collector 106.

In another example, the magnetic flux collector 106 may be formed as magnetically conductive bars, such as steel bars, formed in/on the support frame 102. In this example, the support frame 102 may be coupled directly with the magnet housing 202 as in conventional loudspeakers. However, the conductive bars may be coupled with the support frame 102 to contact the magnet housing 202 when the support frame 102 is coupled to the magnet housing 202 in order to form a channel through which magnetic flux may flow. The conductive bars may be coupled externally to the support frame 102, such as by mechanical coupling, adhesive, fasteners, etc. Alternatively, the conductive bars may be overmolded into the support frame 102 to provide sufficient magnetic flux carrying capacity. If the conductive bars are overmolded, at least a portion of each of the magnetic bars may include retention apertures. In addition, a portion of the conductive bars may not be overmolded with plastic in order to form a magnetically conductive flow path between each of the conductive flow paths and the magnet housing 202. In still other examples, the plastic used to form the support frame may include magnetically conductive particles dispersed throughout the plastic for form a magnetically conductive path through the support frame 102.

In FIG. 8, the three piece design includes the flux collector 106 as a first piece, and the magnet housing 202 includes the second and third pieces. Specifically, the second piece is the wall of the magnet housing 202 that forms a hollow housing 802, and the third piece is the base of the magnet housing 202 that forms a base plate 804. The hollow housing 802 may include open ends. The base plate 804 may be formed to fit within one of the open ends of the hollow housing 802. The hollow housing 802 may include a flange 806 that allows the base plate 804 to extend a predetermined distance into a cavity 808 formed in the hollow housing 802. The flange 806 may circumvent at least a portion of an internal surface of the hollow housing 802 and form a shelf upon which the base plate 804 may rest. The base plate 804 may be coupled with the hollow housing 802 by welding, glue, friction fit, one or more fasteners, or any other coupling mechanism to fixedly couple the hollow housing 802 and the base plate 804. In FIG. 8, the base plate 804 includes a central aperture 810 formed to accommodate the centering pin 204 (FIG. 2) and a plurality of adjacent apertures 812 to accommodate the fasteners, such as the machine screws 402 (FIG. 4). In other examples, no apertures, fewer apertures, or additional apertures may be included in the base plate 804.

In FIG. 8, an example coupling mechanism in the form of a stake on 814 is illustrated for coupling the magnetic flux collector 106 to the magnet housing 202. The magnet housing 202 includes a shoulder 816. The shoulder 816 may concentrically surround the magnet housing 202 and be formed integral with the magnet housing 202, or as a separate structure coupled with the magnet housing 202 by welding, glue, press fit, or other coupling mechanism.

During manufacturing, the stake on 814 is created by inserting the magnet housing 202 into a central aperture concentrically formed in the magnetic flux collector 106. The magnet housing 202 may be inserted into the magnetic flux collector 106 until a portion of the magnetic flux collector 106 proximate the inner diameter of the magnetic flux collector 106 is resting on the shoulder 816. A portion of the hollowing housing 802 extending through the aperture in the magnet housing 202 may be bent downward onto the body of the magnetic flux collector 106 to compress the portion of the magnetic flux collector 106 between the shoulder 804 and the bent portion of hollowing housing 802. Thus, the magnetic flux collector 106 may be fixedly held in position with respect to the magnet housing 202. In other examples, other forms of coupling mechanisms are possible, as previously discussed. Following overmolding and coupling (if needed), the combination of the magnetic flux collector 106 and the magnet housing 202 may be mechanically coupled with the support frame 102 (FIG. 1).

Figure 9:
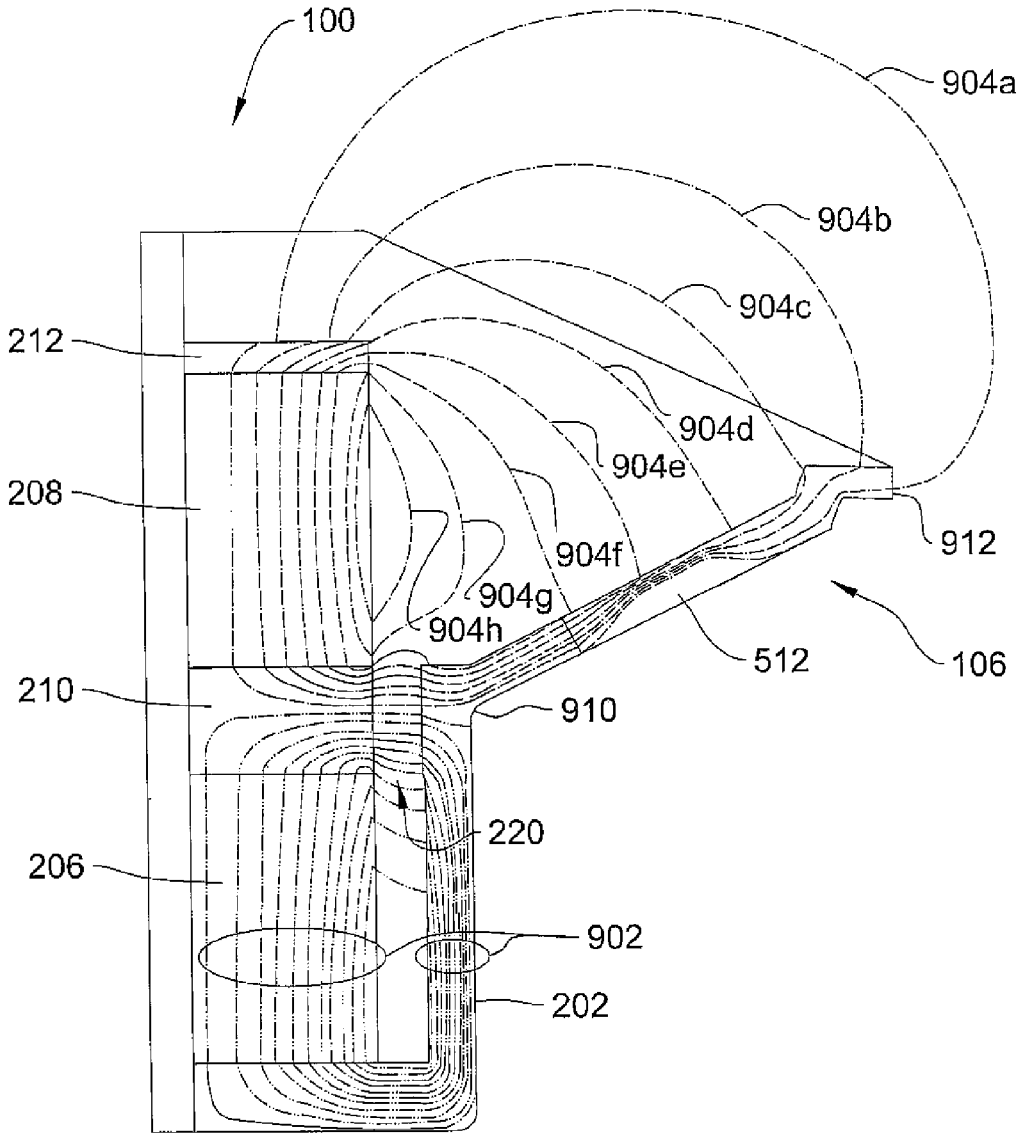
FIG. 9 is a portion of the loudspeaker of FIG. 6 depicted with magnetic flux lines.

FIG. 9 is a cutaway side view of a portion of the loudspeaker 100 of FIG. 2 that includes the magnet housing 202 and magnetic flux collector 106, with the support frame 102 and the spider 108 removed for clarity. In FIG. 9, example modeling of the paths of the magnetic flux included in the magnetic fields produced by the magnets 206 and 208 is depicted as a plurality of magnetic flux lines.

The magnetic flux of the first magnet 206 is illustrated with primary magnetic flux lines 902. The primary magnetic flux lines illustrate that the magnetic flux from the first magnet 206 is channeled through the magnet housing 202 to the air gap 220 and then to the first core cap 210. The air gap 220 is formed between the magnet housing 202 and the motor assembly 104 to concentrate the magnetic flux of the magnets 206 and 208 in a predetermined location with respect to the voice coil 222 (FIG. 2).

The magnetic flux of the second magnet 208 is illustrated with bucking magnetic flux lines 904. A first bucking magnetic flux line 904*a*, exits the second core cap 212 and travels through air until it reaches the outer diameter, or outer peripheral edge, of the magnetic flux collector 106. The first bucking magnetic flux line 904*a* is received with the magnetically conductive magnetic flux collector 106, is channeled to the air gap 220 formed between the magnet housing 202 and the magnets 206 and/or 208. Similarly, other bucking magnetic flux lines 904*b*-904*f* enter the magnetic flux collector 106 at various points, or diameters, along the length of the body of the magnetic flux collector 106 and are channeled to the air gap 220 via the magnet housing 202.

The magnetic flux of the first and second magnets 206 and 208 is concentrated in the air gap 220 in a predetermined location proximate the voice coil. In FIG. 9, the predetermined location is adjacent to the first core cap 210, such that the majority of the magnetic flux from both the first and second magnets 206 and 208 (substantially all the magnetic flux) is also channeled through the first core cap 210. However, some of the magnetic flux from the first magnet 206 may be channeled only through the magnet housing 202, and some of the magnetic flux from the second magnet 208 may not be channeled through the magnetic flux collector 106.

In FIG. 9, the magnetic flux collector 106 is coupled with the magnet housing 202 at a proximal end 910 proximate the inner diameter 502 (FIG. 5), and extends away from the magnet housing 202 at a determined angle to a distal end 912 proximate the outer diameter of the magnetic flux collector 106. The determined angle forms a clearance area between the second magnet 208 and the magnetic flux collector 106, within which the spider 108 may reciprocate with the voice coil 222 (FIG. 2) without contacting the magnetic flux collector 106, or the magnet housing 202. Thus, the determined angle may be any angle that forms a volume of air space sufficient to allow excursions of the spider 108 and voice coil 222 assembly without contact with the flux collector 106, or any other structure included in the loudspeaker 100.

The magnitude of the magnetic flux increases closer to the proximal end 910 due to an increase in the number of bucking magnetic flux lines 904 entering the magnetic flux collector 106. Accordingly, the magnetic flux carrying capacity of the magnetic flux collector 106 may be greatest nearest the magnet housing 202. The magnetic flux carrying capacity of the magnetic flux collector 106 may be lower closer to the distal end 912. Thus, the thickness of the magnetic flux collector 106 may taper to be thickest proximate the inner diameter of the magnetic flux collector 106, and thinnest proximate the outer diameter of the magnetic flux collector 106. In FIG. 9, one of the vent apertures 512 is illustrated. Since there is less magnetically conductive material in the vicinity of the vent aperture 512, the density of the magnetic flux channeled in the magnetic flux collector 106 correspondingly increases. In addition to the magnetic flux collector 106, the support frame 102 also may be made of ferromagnetic material to enable channeling of the magnetic flux from the motor assembly 104 (FIG. 1). Alternatively, or in addition, a ferromagnetic grill may be used with the loudspeaker 100 to enable additional channeling of the magnetic flux. The ferromagnetic grill may be concentric with the central axis 216 (FIG. 2) and may provide a barrier over the cone 304 (FIG. 3) to protect the cone 304 from damage by external objects and/or to provide an attractive cover over the loudspeaker 100. Stray magnetic flux of the magnetic field from at least the second magnet 208 may be directed and channeled to the air gap 220 (FIG. 2) with the support frame 102 and/or the grill. In addition, the ferromagnetic material of the support frame 102 and/or the grill my provide magnetic shielding of components positioned external to the loudspeaker in the vicinity of the first and second magnets 206 and 208 so that the affect of the magnetic field of the first and second magnets 206 and 208 on such components is minimized. In addition, or alternatively, the support frame 102 and/or the grill may be made from a material of high thermal conductivity to enhance heat dissipation of the loudspeaker 100.

In another example, a thickness of the second core cap 212 (FIG. 2) may be increased. The increased thickness of the core cap 212 may be in the form of a ferromagnetic extension member that is coupled to the second core cap 212. Alternatively, the second core cap 212 may be formed with additional material to increase the thickness, or multiple core caps may be stacked to provide increased thickness. The increase in thickness of the second core cap 212 may be sufficient to form one or more magnetically conductive channels to the support frame 102 and/or the grill to enable efficient channeling of the magnetic flux to the air gap 220 (FIG. 2). If the extension of the second core cap 212 is made from a material that is also of high thermal conductivity, the heat dissipation of the loudspeaker also may be enhanced.

Figure 10:
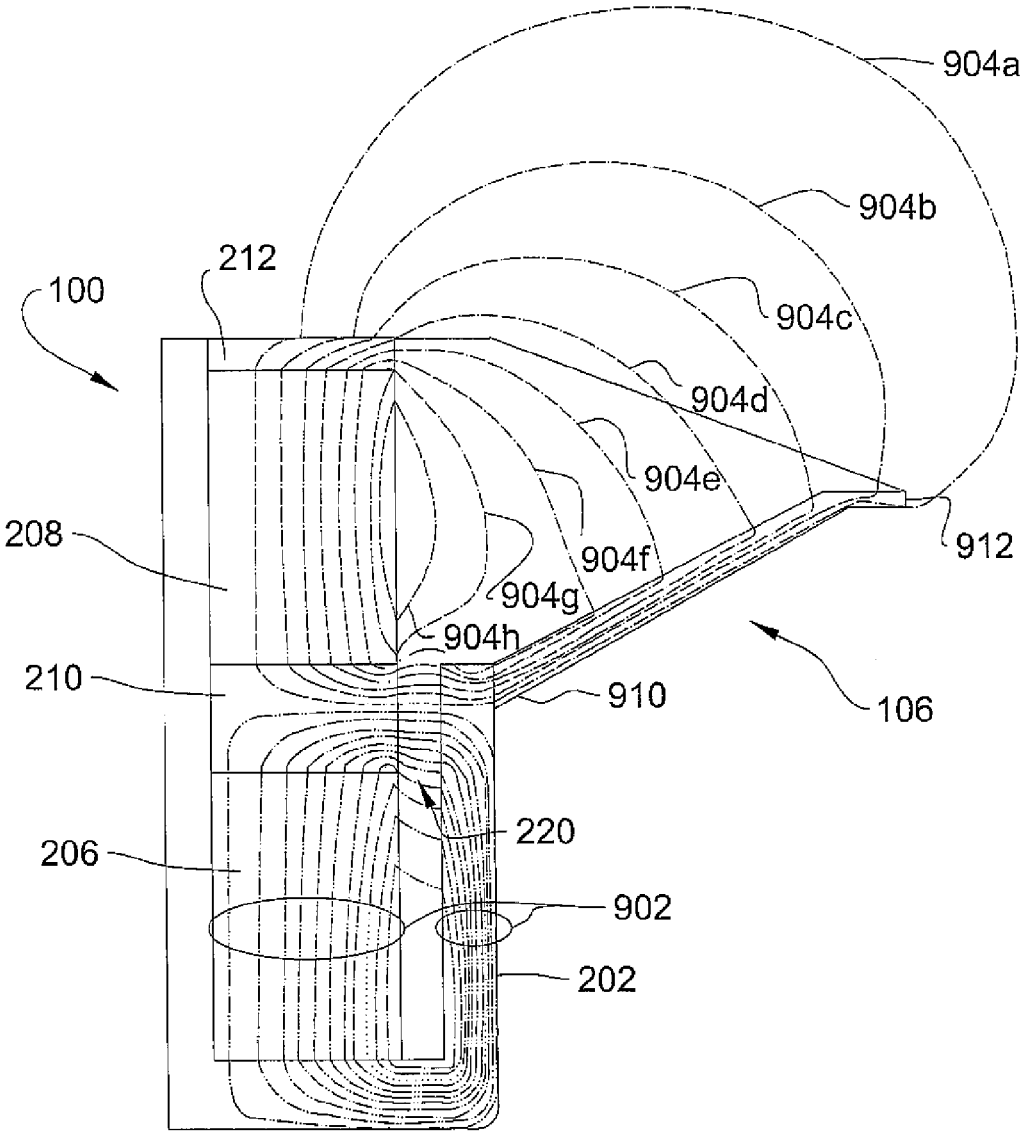
FIG. 10 is also a portion of the loudspeaker of FIG. 6 depicted with magnetic flux lines.

FIG. 10 is another cross section of a portion of the loudspeaker of FIG. 2 that includes the magnet housing 202 and magnetic flux collector 106, with the support frame 102 and the spider 108 removed for clarity. In FIG. 10, the magnetic flux collector 106 is shown in a cross section that is between the vent apertures 512 (FIG. 5) to further illustrate that the thickness of the magnetic flux collector 106 is tapered to be thickest near the proximal end 160 and progressively becomes thinner toward the distal end 162 in accordance with the reduction in the number of magnetic flux lines in the magnetic flux collector 106. In FIG. 10, the taper is a uniform taper, in other examples, the taper may be a curved taper, stepwise taper, or other non-linear taper. In still other examples, the thickness may be uniform between the proximal end 910 and the distal end 912.

In FIGS. 9 and 10, the magnetic flux carrying capacity of the magnetic flux collector 106 may be sufficient to maintain the magnetic flux density, measured in teslas, T, through the magnetic flux collector 106 at or below a determined magnitude. The magnetic flux carrying capacity of the magnetic flux collector 106 is affected by the diametric surface area and/or cross sectional area of the magnetic flux collector 106. The larger the diametric surface area and/or the cross sectional area, the more magnetic flux may flow through the magnetic flux collector 106 without exceeding a desired magnitude of teslas of magnetic flux density. Thus, the number of apertures 512, the size of the magnetic flux collector 106, the magnetic conductivity of the material from which the magnetic flux collector 106 is made, and the thickness of the material forming the magnetic flux collector 106 may change the magnetic flux carrying capacity.

In one example, the desired magnitude of the magnetic flux density of the magnetic flux collector 106 is about 2 T or less. In another example, the magnetic flux density of the magnetic flux collector 106 may be maintained in a range from about 1 T to about 2 T. In still another example, the magnetic flux density of the magnetic flux collector 106 may be maintained less than about 2.2 T.

A diametric surface area of the magnetic flux collector 106 may be determined at any diameter point (p) between a determined outer diameter of the magnetic flux collector 106 (the distal end 912) and a determined inner diameter of the magnetic flux collector 106 (the proximal end 910). Thus, the minimum volume of material, such as steel, needed to form the magnetic flux collector 106 and maintain less than the desired magnitude of teslas may be determined taking into consideration the apertures 512 formed in the magnetic flux collector 106, other materials included in the construction of the magnetic flux collector 106, and/or any other variables in the diametric surface area of the magnetic flux collector 106 by selecting a diameter point (p) that does not include the variable. In one example, the diametric surface area ($D_s$) may be determined at any diameter point (p) between the proximal end 910 and a variable, such as a circular row of apertures 512, by:

$$D_s = \frac{((3\times\text{Mod}) - Fdp)}{((3\times\text{Mod}) - SPod)} \times \left[1.55 \times \left(\frac{\text{Mod}}{24.6}\right)^2 \times \left(\frac{\text{Mod}}{SPod}\right) \times \left(\frac{Me}{45}\right)^{0.5} \times (\pi) \times (Fdp)\right]. \quad \text{Equation 1}$$

Where Mod is the outside diameter of the second magnet 208, Fdp is the diameter of the magnetic flux collector 106 at the diameter point (p), SPod is the magnet housing outside diameter at the proximal end 910 of the magnetic flux collector 106, and Me is the magnet energy product in Mega Gauss× Oersted (MgO) of the second magnet 208.

The intensity of the magnetic flux in the magnetic flux collector 106 may be based on the configuration of the motor assembly 104. Specifically, the strength of the magnetic fields produced by the magnets 206 and 208, the position of the magnets 206 and 208 with respect to the magnet housing 202 and/or the magnetic flux collector 106, the point at which the magnet housing 202 and the magnetic flux collector 106 are coupled, and/or the diameter of the magnet housing 202 and/or the magnets 206 and 208. An example formula to determine a minimum thickness ($T_{inside}$) of the magnetic flux collector 106 at the proximal end 160 that maintains less than an optimal magnitude of teslas, such as 2 T, may be:

$$T_{inside} = 1.55 \times \left(\frac{Mod}{24.6}\right)^2 \times \left(\frac{Mod}{SPod}\right) \times \left(\frac{Me}{45}\right)^{0.5}. \quad \text{Equation 2}$$

The outer diameter of the magnetic flux collector 106 may be selected to optimize the effectiveness of channeling the magnetic energy to the magnet housing 202. In one example, the outer diameter of the magnetic flux collector 106 may be about three times an outside diameter of the second magnet 208. In another example, when the outer diameter of the magnetic flux collector 106 is less than or equal to three times the outside diameter of the second magnet 208, the minimum thickness ($T_{outside}$) of the magnetic flux collector 106 at the outer diameter in order to maintain less than the optimal magnitude of teslas, such as 2 T, may be:

$$T_{outside} = \frac{((3\times\text{Mod}) - Fod)}{((3\times\text{Mod}) - SPod)} \times \left[1.55 \times \left(\frac{\text{Mod}}{24.6}\right)^2 \times \left(\frac{\text{Mod}}{SPod}\right) \times \left(\frac{Me}{45}\right)^{0.5}\right]. \quad \text{Equation 3}$$

Where the Fod is the outer diameter of the magnetic flux collector 106. It is to be noted that since Equation 3 is used to determine a minimum acceptable value to maintain less than [?] the desired magnitude of Teslas, if the outer diameter (Fod) is greater than three times the diameter of the second magnet 208, Equation 3 will produce a negative number, and thus does not provide a valid result. For the same reason, Equation 1 will similarly produce a negative number that is not a valid result when the diameter of the magnetic flux collector 106 at the diameter point (p) (Fdp) is selected to be greater than three times the diameter of the second magnet 208.

Any material formed as part of the magnetic flux collector 106 that is beyond the optimal range, such as extra thickness and/or an extended outer diameter of the magnetic flux collector 106, is not detrimental to the performance of the magnetic flux collector 106 as an efficient channel for magnetic energy, but can add material costs, weight and size. In addition, a magnetic flux collector 106 that includes less material will still offer benefits, but to a lesser degree than if the thickness and diametric surface area were at least at the minimum amounts to optimize performance as determined from Equations 1-3. Further, the constant of 1.55 indicated in Equations 1-3 may change depending on the material from which the magnetic flux collector 106 is constructed. In the examples of Equations 1-3, the magnetic flux collector 106 is formed with 1010 steel.

Thus, by varying the diametric surface area and/or the thickness of the magnetic flux collector 106, the magnetic flux density of the magnetic flux collector 106 may be maintained below a predetermined desired magnitude. In one example, the thickness of the magnetic flux collector 106 may be selected to be in a range of between about 1 mm to about 4 mm thick.

The thickness of the magnetic flux collector 106 may also be tapered to be thickest near the proximal end 910 and gradually become thinner toward the distal end 912 in accordance with the reduction in the number of magnetic flux lines in the magnetic flux collector 106 toward the distal end 912. In one example the proximal end 910 may be greater than 1.2 mm thick, for example 2.4 mm thick. In FIG. 9, one of the apertures 512 is also depicted, as previously discussed. The apertures 512 may be formed in the magnetic flux collector 106 to be spaced away from the proximal end 910 by a determined distance in order to avoid too much reduction in the volume of material in the magnetic flux collector 106 through which the magnetic energy may flow. As previously discussed, if the area of material from which magnetic flux collector 106 is formed becomes less than a certain amount, the magnetic flux density may increase beyond a determined threshold limit, such as 2 T. Accordingly, apertures 512 may be advantageously spaced away from the proximal end 910 in order take advantage of the larger surface area of the magnetic flux collector 106, and the fewer lines of magnetic flux flowing in the magnetic flux collector 106.

Without the magnetic flux collector 106, the paths of the magnetic flux lines for the second magnet 208 would be considerably longer and include significantly more travel through air than the magnetic flux lines illustrated in FIGS. 9 and 10. Since the magnetic energy from the magnets is traveling through more air, less magnetic energy is available to interact with the voice coil. Thus, due to the lower magnetic energy, more power is needed from the electrical signal to produce a similar magnitude of movement in the cone 304 (FIG. 3) when compared to the example of FIGS. 9 and 10. In other words, using the magnetic flux collector 106 may reduce the amount of power required to drive the loudspeaker to produce audible sound at a decibel level similar in magnitude to a loudspeaker that did not include the magnetic flux collector 106.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A loudspeaker comprising:

a plurality of magnets configured in a motor assembly to each produce a magnetic flux;

a magnet housing configured to surround one of the magnets and have at least one of the magnets not surrounded by the magnet housing, the magnet housing comprising a magnetically conductive material; and a magnetic flux collector coupled with the magnet housing and extending outwardly away from the magnet housing to a distal end proximate an outer diameter of the magnetic flux collector;

where the magnetic flux collector is a magnetically conductive material configured to receive and channel the magnetic flux of the at least one of the magnets not surrounded by the magnet housing to an air gap formed between the magnet housing and the motor assembly;

the at least one of the magnets not surrounded by the magnet housing having a distal end positioned at a greater axial distance from the magnet housing that is the magnetic flux collector distal end.

2. The loudspeaker of claim 1, where the magnet housing is concentrically positioned with respect to a central axis of the loudspeaker, and the magnetic flux collector is concentrically positioned with respect to the magnet housing and the central axis of the loudspeaker.

3. The loudspeaker of claim 1, further comprising:

a support frame;

a cone coupled with the support frame; and a voice coil coupled with the cone and positioned proximate the magnets;

where a distal end of the magnetic flux collector is coupled to the support frame and a proximal end of the magnetic flux collector is coupled with the magnet housing, and the magnetic flux collector is operable as a structural member to maintain a position of the magnet housing with respect to the support frame.

4. The loudspeaker of claim 1, where the magnetic flux collector is integrally formed with the magnet housing as part of a single unitary structure.

5. The loudspeaker of claim 1, further comprising:

a support frame;

a cone coupled to the support frame;

a voice coil coupled with the cone and positioned proximate the magnets; and a spider coupled with the voice coil at an inner periphery, and coupled with the magnetic flux collector at an outer periphery, the magnetic flux collector also coupled with the support frame.

6. The loudspeaker of claim 1, where the plurality of magnets comprise a first magnet and a second magnet, where the first magnet is surrounded by the magnet housing and the second magnet is entirely outside the magnet housing, and where a first magnetic flux of the first magnet is channeled with the magnet housing to the air gap, and a second magnetic flux of the second magnet is channeled with the magnetic flux collector to the air gap.

7. The loudspeaker of claim 1, where the magnetic flux collector comprises a spider platform coupled with a spider, the spider coupled with a voice coil positioned in the air gap, where the spider is rigidly coupled with the spider platform and configured to allow the voice coil to reciprocate axially along a central axis of the loudspeaker, where the magnetic flux collector is positioned adjacent the spider and comprises a plurality of vent apertures formed in the magnetic flux collector, the vent apertures operable to provide air flow to the spider as the voice coil reciprocates.

8. The loudspeaker of claim 1, where the magnetic flux collector comprises a plurality of magnetically conductive bars.

9. A loudspeaker comprising:

a motor assembly including a first magnet and a second magnet, each of the first magnet and the second magnet configured to produce a magnetic flux, the second magnet having a distal end facing away from the first magnet;

a magnet housing configured to surround the first magnet and not surround the second magnet, the magnet housing further configured to channel a first magnetic flux of the first magnet to an air gap formed between the magnet housing and the motor assembly;

a support frame; and a magnetic flux collector having a proximal end coupled to the magnet housing and the magnetic flux collector having a distal end coupled to the support frame at an axial distance from the magnet housing that is less than the axial distance from the magnetic housing to the second magnet distal end, the magnetic flux collector configured to receive and channel a second magnetic flux of the second magnet through the magnet housing to the air gap.

10. The loudspeaker of claim 9, where the magnetic flux collector includes an inner diameter forming a central aperture and an outer diameter forming a periphery of the magnetic flux collector, the inner diameter and the outer diameter concentric with a central axis of the loudspeaker.

11. The loudspeaker of claim 10, where the outer diameter of the magnetic flux collector is about three times larger than an outside diameter of the second magnet.

12. The loudspeaker of claim 9, where a magnetic flux density of the second magnetic flux channeled with the magnetic flux collector is greater than or equal to about 1.0 teslas and less than or equal to about 2.2 teslas.

13. The loudspeaker of claim 9, where a thickness of the magnetic flux collector is tapered between a first thickness proximate the magnet housing and a second thickness spaced away from the magnet housing, where the first thickness is greater than the second thickness.

14. The loudspeaker of claim 13, where the thickness of the magnetic flux collector is configured to taper between the first thickness and the second thickness at a rate that maintains the magnetic flux density in the magnetic flux collector below a predetermined magnitude of flux density.

15. A magnetic flux collector configured to receive and channel magnetic flux in a loudspeaker, the loudspeaker including a support frame, a first magnet and a second magnet configured to each produce a magnetic flux, the second magnet having a distal end facing away from the first magnet, and a magnet housing configured to surround the first magnet and have the second magnet entirely outside the magnet housing, the magnetic flux collector comprising:

a body extending between an inner diameter and an outer diameter;

the outer diameter having a distal end configured to couple with the support frame at an axial distance from the magnet housing that is less than the axial distance from the magnetic housing to the second magnet distal end;

the inner diameter having a proximal end configured to couple with the magnet housing; and where a thickness of the body is tapered between the inner diameter and the outer diameter such that the body is thicker near the inner diameter than near the outer diameter; and where the inner diameter forms an aperture operable to receive the magnet housing.

16. The magnetic flux collector of claim 15, where the body comprises a plurality of vent apertures that penetrate the body between the inner diameter and the outer diameter.

17. The magnetic flux collector of claim 15, where the thickness of the body is configured to maintain a magnetic flux density of the magnetic flux collector greater than or equal to about 1.0 teslas and less than or equal to about 2.2 teslas between the inner diameter and the outer diameter.

18. The magnetic flux collector of claim 15, where a minimum thickness ($T_{inside}$) of the body proximate the inner diameter is determined by:

$$T_{inside} = 1.55 \times \left(\frac{Mod}{24.6}\right)^2 \times \left(\frac{Mod}{SPod}\right) \times \left(\frac{Me}{45}\right)^{0.5}$$

where Mod is a second magnet outside diameter of the second magnet,

SPod comprises a housing outside diameter of the magnet housing proximate the inner diameter of the body, and Me comprises a magnet energy product in Mega Gauss× Oersted (MgO).

19. The magnetic flux collector of claim 15, where a minimum thickness ($T_{outside}$) of the body proximate the outer diameter is determined by:

$$T_{outside} = \frac{((3 \times \text{Mod}) - Fod)}{((3 \times \text{Mod}) - SPod)} \times \left[1.55 \times \left(\frac{\text{Mod}}{24.6}\right)^2 \times \left(\frac{\text{Mod}}{SPod}\right) \times \left(\frac{Me}{45}\right)^{0.5}\right]$$

where Mod is a second magnet outer diameter of the second magnet,

SPod comprises a housing outside diameter of the magnet housing proximate the outer diameter of the body, Me comprises the magnet energy product in Mega Gauss× Oersted (MgO), and Fod comprises the outer diameter of the body.

20. The magnetic flux collector of claim 15, where the outer diameter comprises a thickness of greater than about 1.2 mm, and the inner diameter comprises a thickness less than or equal to about 4 mm.

21. A method of assembling a loudspeaker comprising the steps of:

constructing a first assembly of the loudspeaker, the first assembly including a magnet housing surrounding at least one of a plurality of magnets included in a motor assembly, at least one of the plurality of magnets being positioned entirely outside the magnet housing and having a distal end facing away from the magnet housing, the magnets operable to each produce a magnetic flux, the first assembly also including a magnetic flux collector having a proximal end coupled to the magnet housing and a distal end situated at an axial distance from the magnet housing that is less than the axial distance from the magnetic housing to said magnet distal end, the magnet housing and the magnetic flux collector each configured to receive and channel the magnetic flux of the magnets to an air gap formed between the magnet housing and the motor assembly;

constructing a second assembly of the loudspeaker, the second assembly including a support frame and a cone attached to the support frame, and coupling the first assembly and second assembly.

22. The method of claim 21, further comprising the step of:

replacing the second assembly with a replacement assembly, the replacement assembly including a replacement support frame and a replacement cone attached to the replacement support frame.

23. The method of claim 21, where coupling the first assembly and the second assembly further comprises at least one of fastening the first assembly to the second assembly with a threaded fastener, welding the first assembly to the second assembly, and fastening the first assembly to the second assembly with a snap fit or a frictional fit.

24. A method of producing sound with a loudspeaker, comprising:

producing a first magnetic flux with a first magnet included in a motor assembly, where the first magnet is surrounded with a magnet housing that is magnetically conductive;

producing a second magnetic flux with a second magnet included in the motor assembly, where the second magnet is entirely outside the magnet housing and has a distal end facing away from the magnet housing;

receiving the first magnetic flux with the magnet housing;

receiving the second magnetic flux with a magnetic flux collector, the magnetic flux collector having a proximal end coupled with the magnet housing such that the magnetic flux collector extends away from the magnet housing to a distal end situated at an axial distance from the magnet housing that is less than the axial distance from the magnetic housing to said second magnet distal end, the magnetic flux collector being magnetically conductive; and channeling the first magnetic flux and the second magnetic flux to an air gap formed between the magnet housing and the motor assembly with the magnetic flux collector and the magnet housing.

25. A loudspeaker comprising:

a support frame;

a cone coupled to the support frame;

a plurality of magnets configured in a motor assembly to each produce a magnetic flux;

a voice coil coupled with the cone;

a spider having an outer periphery coupled to the support frame and an inner periphery coupled to the voice coil to position the voice coil in an air gap proximate the magnets;

a magnet housing configured to surround one of the magnets and have at least one of the magnets not surrounded by the magnet housing, the magnet housing comprising a magnetically conductive material channeling the magnetic energy of the magnet surrounded by the magnetic housing through the air gap; and a magnetic flux collector coupled with the magnet housing and extending outwardly away from an inner periphery proximate the magnet housing to an outer periphery coupled to the support frame to maintain position of the magnet housing with respect to the support frame; where the magnetic flux collector outer periphery is located axially closer to the magnet housing than is the distal end of the at least one of the magnets not surrounded by the magnet housing; and where the magnetic flux collector is a magnetically conductive material configured to receive and channel the magnetic flux of the at least one of the magnets not surrounded by the magnet housing through the air gap.

26. The loudspeaker of claim 25, where the at least one of the magnets not surrounded by the magnet housing has a distal end positioned at a greater axial distance from the magnet housing than is the spider inner periphery.

27. The loudspeaker of claim 25, where the thickness of the magnetic flux collector is configured to have a tapering thickness that is thinnest proximate the support frame and thickest proximate the magnet housing.

28. The loudspeaker of claim 27, where the thickness of the magnetic flux collector is configured to taper between a first thickness and a second thickness at a rate that maintains the magnetic flux density in the magnetic flux collector below about 2.2 tesla.

29. The loudspeaker of claim 28, where the thickness of the magnetic flux collector is configured to progressively taper between the first thickness and the second thickness at a uniform rate.

30. The loudspeaker of claim 27, where the thickness of the magnetic flux collector is configured to maintain a magnetic flux density of the magnetic flux collector greater than or equal to about 1.0 tesla.

31. The loudspeaker of claim 27, where a minimum thickness ($T_{inside}$) of the flux collector proximate the magnet housing is determined by:

$$T_{inside} = 1.55 \times \left(\frac{Mod}{24.6}\right)^2 \times \left(\frac{Mod}{SPod}\right) \times \left(\frac{Me}{45}\right)^{0.5}$$

where Mod is a second magnet outside diameter of the second magnet,

SPod comprises an outside diameter of the magnet housing proximate the flux collector, and Me comprises a magnet energy product in Mega Gauss× Oersted (MgO).

32. The loudspeaker of claim 25, where the outer periphery of the flux collector comprises a thickness of greater than about 1.2 mm, and the inner periphery of the flux collector comprises a thickness less than or equal to about 4 mm.

33. The loudspeaker of claim 25, where the magnetic flux collector is integrally formed with the magnet housing as a single unitary structure.

* * * * *